US006893344B2

(12) United States Patent
Brown et al.

(10) Patent No.: US 6,893,344 B2
(45) Date of Patent: May 17, 2005

(54) CASINO STYLE GAMING MACHINE

(76) Inventors: Leif Eric Brown, 3021 Paseo Hills Way, Henderson, NV (US) 89052; Denise J Clark, 3021 Paseo Hills Way, Henderson, NV (US) 89052; John Galvani, 16 West Ave., Penn, Buckinghamshire (GB), HP10 8AE ( * ) Notice: Subject to any disclaimer, the term of this patent is extended or adjusted under 35 U.S.C. 154(b) by 272 days.

(21) Appl. No.: 10/187,688

(22) Filed: Jul. 1, 2002

(65) Prior Publication Data

US 2004/0002374 A1 Jan. 1, 2004

(51) Int. Cl.[7] ..... A63F 9/24
(52) U.S. Cl. ..... 463/25; 463/20
(58) Field of Search ..... 463/16–22, 25, 463/4, 7, 9, 12–13, 26, 29–30, 36, 40–43; 273/138.1, 138.2, 139, 143 R, 292–293; 700/91–93

(56) References Cited

U.S. PATENT DOCUMENTS 5,560,603 A 10/1996 Seelig et al.
5,695,402 A 12/1997 Stupak
5,710,899 A 1/1998 Eick
5,779,544 A 7/1998 Seelig et al.
5,848,932 A 12/1998 Adams
5,919,091 A 7/1999 Bell et al.
5,941,773 A 8/1999 Harlick
5,997,400 A 12/1999 Seelig et al.
6,102,798 A 8/2000 Bennett
6,126,542 A 10/2000 Fier
6,135,885 A 10/2000 Lermusiaux
6,224,486 B1 5/2001 Walker et al.
6,244,957 B1 6/2001 Walker et al.
6,270,409 B1 8/2001 Shuster
6,406,369 B1 * 6/2002 Baerlocher et al. ..... 463/20

* cited by examiner

*Primary Examiner*—Mark Sager
(74) *Attorney, Agent, or Firm*—Quirk & Tratos; Rob L. Phillips

(57) ABSTRACT

A secondary game in communication with a primary gaming machine, is preferably based on a sport, namely American football. The present invention, unlike previous secondary games is triggered in response to both predefined winning and non-winning primary game outcomes. The secondary game awards a bonus pay out in response to a player achieving a predefined bonus event. The bonus event may be scoring a touchdown, getting a first down or any desired football related event. Once the secondary game is triggered by one or more predefined winning primary game outcomes, a random number generator selects a secondary game football related outcome (e.g. five yard gain, two yard loss, etc). In a preferred embodiment, the football outcome is revealed on a display depicting video football footage. Moreover, if the primary game outcome is a predefined non-winning outcome, the secondary game is instructed to advance the football a pre-established modest distance.

24 Claims, 4 Drawing Sheets

CASINO STYLE GAMING MACHINE

FIELD OF THE INVENTION

This invention relates to a gaming machine based on a sports theme. More particularly, a slot machine includes a primary and secondary, or bonus, game, whereby said secondary game operates in response to predefined primary game non-winning events and specific predefined primary game winning events.

BACKGROUND OF THE INVENTION

Modern casinos rely heavily on slot machine revenue. In fact, increasingly slot machines generate a high percentage of a casino's bottom line. The traditional slot machine has three mechanical reels, including gaming indicia thereon, driven by a stepper motor. A random number generator built into, or in communication with, a microprocessor causes the reels and corresponding indicia to stop at random locations resulting in an award if the location of the gaming indicia correspond to predefined locations established by pay lines.

With the increased importance of slot machine revenues, casinos have a constant desire for new games capable of attracting players. To that end, video slot machines, multiple pay line machines and themed machines have been introduced. Moreover, the introduction of slot machines having secondary or bonus games have been very successful in practice. Traditional secondary games only become operable upon a predefined outcome of the primary game. For example, a gaming machine based on Wheel of Fortune® allows the player to "spin the wheel" if the outcome of the primary game so dictates. In practice, The Wheel of Fortune® game requires the third reel of the primary game to stop such that a predesignated gaming indicia is intersected by the pay line. Once the gaming indicia stops at the predefined location, the player presses a spin button and the wheel, placed above the primary game, spins until it slows and lands on a space indicating the number of bonus coins won by the player.

U.S. Pat. No. 5,848,932 (the '932 patent) to Adams discloses and claims "A Method of Playing Game and Gaming Device With At Least One Additional Payout Indicator." The Wheel of Fortune® slot machine practices the claims of the '932 patent and related patents. Other secondary pay out devices, including mechanical pinball drops and video screens, are contemplated by the '932 patent and its family.

U.S. Pat. No. 5,560,603 (the '603 patent) to Seelig et al., describes a slot machine and racing game. Each time a predefined combination of gaming indicia stop at predefined locations on the primary game screen, a signal is generated which advances a racing element (e.g. car or horse) depicted on a racing display corresponding to the specific machine. The principal object of the '603 patent is to attempt to have the player's racing element reach the finish line before a pre-set timer expires. Once the timer expires, the machine, by means of a sensor, determines the final position of the racing element and pays an award according to the final position. U.S. Pat. No. 5,779,544 (the '544 patent) to Seelig et al., describes a combined slot machine and racing game. The '544 patent, in a similar fashion to the '603 patent, discloses a bank of slot machines in communication with one racing display including a plurality of racing elements whereby each racing element races it own clock. As with the '603 patent, once the timer expires, the machine, by means of a sensor, determines the final position of the racing element and pays an award according to the final position. The timing element is designed to encourage players to play at a frenetic pace.

U.S. Pat. No. 6,135,885 (the '885 patent) to Lermusiaux describes an "Electronic Football Wagering Game" that may be implemented as a bonus game. When implemented as a bonus game, the '885 patent discloses that upon a predefined winning outcome for the base game (e.g. slot machine) a random football play is generated by the bonus game. Based on the play, a bonus is awarded to a player. The '885 patent requires a predefined primary game winning outcome to trigger the secondary game. There is no suggestion in the '885 patent that the bonus game operate when the primary game does not achieve a predefined winning outcome.

While the aforementioned patents cover novel concepts, none disclose a secondary game that is operable in response to predefined primary game non-winning events and specific predefined primary game winning events. Moreover, the prior art does not suggest or claim a secondary game that advances a player towards a bonus award based on continuous play of the primary game. For example, most secondary games award a bonus instantly upon a single play independent of the next play. The present invention addresses the deficiencies of the prior art by providing a secondary game whereby said secondary game operates in response to both predefined non-winning events and predefined winning events of the primary game, and maintains the previous secondary game results for summation with future secondary results.

SUMMARY OF THE INVENTION

An object of the present invention is to provide a secondary or bonus game which operates in response to a majority of plays of a primary game.

Another object of the present invention is to provide an incentive for a player to continue playing a particular gaming machine.

Another object of the present invention is to provide a secondary game that provides a player with advancement to an award based on both predefined non-winning and predefined winning events of a primary game.

Another object of the present invention is to provide a secondary or bonus game with video elements.

Yet another object of the present invention is to provide a secondary game that maintains previous secondary game results for summation with future secondary results until a predefined value is achieved or surpassed.

DISCLOSURE OF THE INVENTION

The present invention relates to a primary slot machine style game, including a secondary or bonus game in communication therewith. Preferably the secondary game is based on American football or other suitable sporting event. It should be understood that the game does not have to be based on American football, or any sport, as long as the secondary game involves an advancement, based on predefined primary game events, towards a bonus award. However, American football is discussed exclusively throughout to describe the present invention. Gambling and American football have become synonymous. In Las Vegas and other jurisdictions which permit wagering on live sporting events professional and college football attract a great majority of the sports wagering action. The present invention combines the most popular casino game, a slot machine, with the most wagered upon sport, American football.

A traditional slot machine includes three or more mechanical or video depicted reels. The reels each have gaming indicia depicted thereon. Activation of the slot machine causes the reels to spin or appear to spin such that the gaming indicia move past a display area. At some point, determined by a microprocessor and random number generator, the reels stop and a player either wins or loses based on the final position of the gaming indicia. A mentioned previously, many slot machines now have secondary games triggered by a predefined winning event of the primary game.

The secondary game described herein is preferably implemented in a video format so as to maximize the realism, energy and excitement surrounding a player's experience. A video display, including plasma displays, CRT displays, LCD displays and the like, in communication with a primary gaming machine exhibits at least a football field and a means for indicating a position of a football. Preferably however, the video display exhibits actual football players, cheerleaders, referees, a crowd and other aspects commonly associated with a football game. The object of the secondary game is for the player to realize a predefined bonus event, such as scoring a touchdown or getting a first down, which results in a bonus award.

Unlike the traditional secondary game, the secondary game described herein operates in response to predefined non-winning primary game events rather than only predefined winning events. First, the secondary game is triggered when the primary game outcome is of a predefined winning nature (e.g. one or more gaming indicia stop in a predefined location). Second, the secondary is triggered when the primary game outcome is of a predefined non-winning nature (e.g. the final position of the gaming indicia results in no player pay out).

Upon one or more predefined winning outcomes of the primary game, the secondary game is triggered and a random football outcome is generated. The predefined winning outcome of the primary game is preferably based on the final position of one or more gaming indicia. It is envisioned that the gaming indicia may include footballs, players in full pads, field goal posts and those items generally associated with football. By way of example, the random secondary game outcome related to a predefined outcome of the primary game may be a 10-yard gain, a touchdown pass, a 2-yard loss, etc. The secondary game outcome and new position of the football are then depicted on the video display. As disclosed, an objective of the secondary game is for the player to realize a predefined bonus event. Although scoring a touchdown is the preferred predefined bonus event, other football outcomes, including first downs, may also result in a bonus award to the player.

Should the final position of the gaming indicia not match a predefined winning outcome, the secondary game will nonetheless be triggered upon a predefined non-winning primary game outcome. Based on a predefined non-winning primary game outcome, a predefined secondary game outcome is realized. Preferably, the predefined secondary outcome based on a predefined primary game non-winning outcome is a 1-yard gain or advancement of the football. In this manner, the player advances towards the end zone or other bonus event even if the player loses the primary game. The predefined secondary outcome should be small to encourage the player to play a specific gaming machine for an extended period of time.

The amount of the bonus award may be based on the number of plays of the primary game required to reach the end zone or get a first down, such that a greater bonus amount corresponds to a lessor number of plays needed to achieve the bonus event. Alternatively, the amount of the bonus award may be generated randomly upon the occurrence of the bonus event or predefined in a pay table.

Should a player decide to abandon a specific machine, the position of the football remains at its final position to the benefit of a new player. Again, the result is that a player is compelled to play a particular machine for an extended period of time knowing that the bonus event will be achieved eventually even though the primary game outcomes may be disappointing.

A BRIEF SUMMARY OF THE GAME AND METHOD OF PLAY

By way of example, a slot machine with a primary game having three mechanical reels and a video implemented secondary game is considered. Of course, a primary game with video depicted reels is clearly within the scope of the present invention. Unless the machine has been abandoned by a previous player, the initial position of a football may be placed any pre-established distance (e.g. 40 yards) from a bonus end zone. In other embodiments, the position of the football may be randomly assigned by the machine or be dependent on the outcome of the first play of the primary game. If the previous player abandons the gaming machine, the football remains at its position subsequent to the previous player's last play. In this manner, the next player may take advantage of the previous player's advancement toward the bonus event.

A player first places a wager in the form of coins, currency or a credit-type card. As known in the art, the primary game is triggered in the normal fashion (e.g. arm pulled or spin button depressed) and gaming indicia spin until each reel stops in succession from left to right. If the gaming indicia match one or more predefined primary game winning outcomes, the secondary game is triggered. A random number generator selects a football related outcome from a library of pre-stored outcomes. In this example, a 5-yard gain outcome is selected. The 5-yard gain is depicted on the video display by showing a ball marker or the football advancing 5 yards along a displayed football field. In the preferred alternative, the video display shows pre-stored video of an actual football game play resulting in a 5-yard gain. If the gaming indicia match one or more predefined non-winning primary game outcomes, the secondary game is nonetheless triggered and the ball is advanced a nominal pre-established distance (e.g. preferably 1 yard). Based on the primary game results, the secondary game operates by advancing the football towards a bonus event.

Once a predefined bonus event, such as scoring a touchdown, getting a first down, etc., is realized, the player is paid a bonus amount. The bonus amount may be randomly generated, may be based on the number of plays necessary to realize the predefined bonus event, may be based on the distance of the particular play resulting in the realization of the predefined bonus event or may be pursuant to a predefined pay table. Although not described fully herein, it should be noted that any football related outcomes including, but not limited to, loss of possession, field goals, etc., can be incorporated into the present invention without departing from the scope and spirit of the invention described herein.

DESCRIPTION OF THE EMBODIMENTS

Figure 1:
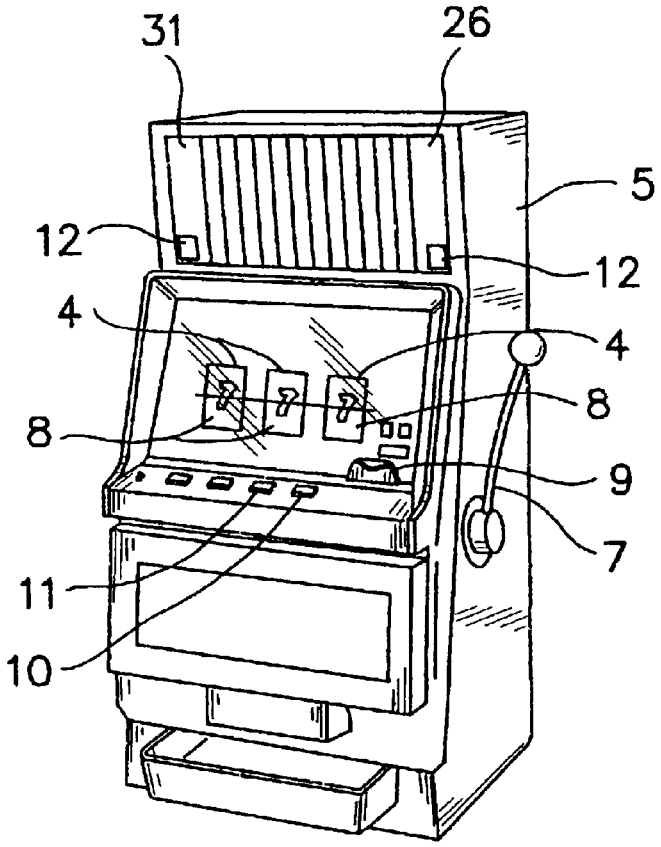
FIG. 1 illustrates a front view of the present invention implemented on a traditional slot machine.
Figure 1A:
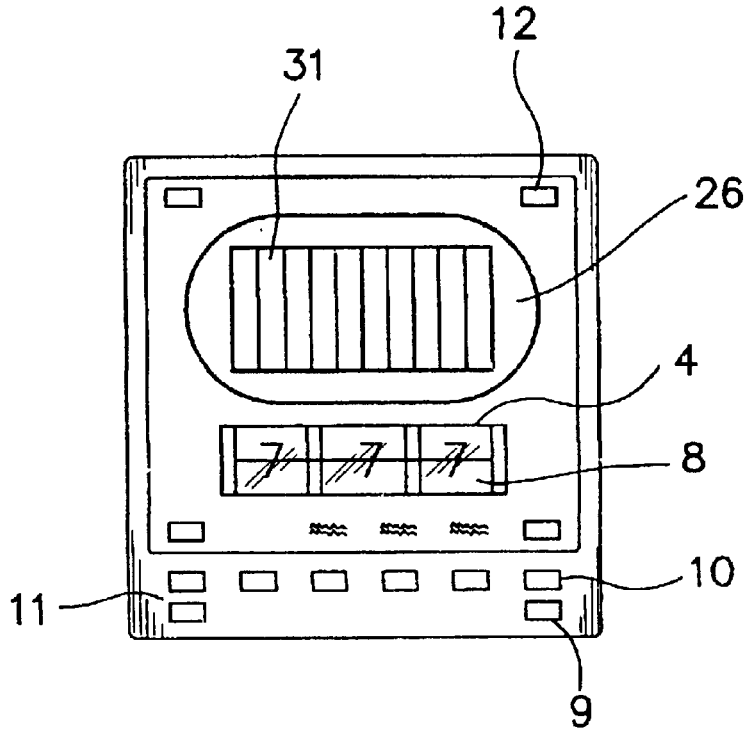
FIG. 1A illustrates a top view of the present invention implemented on a gaming machine integrated into a bar counter-top.

Reference is now made to the figures wherein like parts are referred to by like numerals throughout. FIG. 1 illustrates a primary gaming machine 5, in the form of a slot machine, communicating with a secondary bonus game according to the present invention. The slot machine of FIG. 1 includes three reels 4 of the primary game 5, an activation arm 7, gaming indicia 8, coin slot 9, bet maximum coins button 10 and bet one coin button 11. The secondary bonus game is implemented in video format by means of a video display 26 in communication with the primary game 5. A "yardage to go" display device 12 informs players of the updated yardage necessary to achieve a bonus. FIG. 1A shows the present invention implemented on a gaming machine integrated into a bar counter-top or the like.

Figure 2:
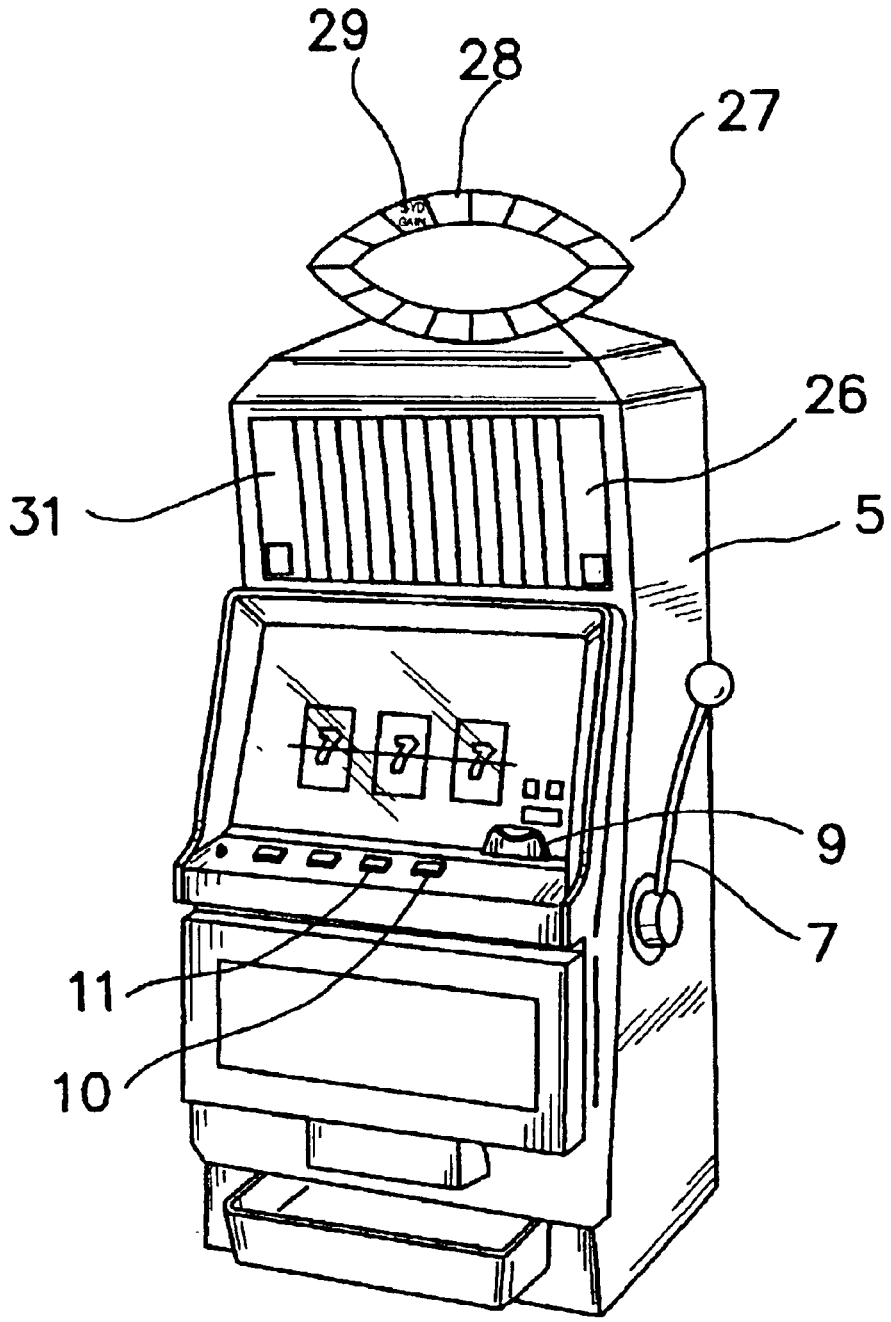
FIG. 2 illustrates a front view of the present invention including a secondary game apparatus for displaying the random generation of the secondary game outcome.

FIG. 2 shows an alternative embodiment of the present invention including a secondary game apparatus 27 designed to display the generation of a secondary bonus game outcome.

The primary gaming machine 5 is initiated by inserting coins, bills or credit type cards into a bill validator (not shown), the coin slot 9 and/or a card reader (not shown) of the primary game 5. Thereafter, a player elects the number of coins he or she desires to wager on the play of the game. Normally, a player electing to play maximum coins (e.g. 3 coins) is afforded certain benefits, namely participation in progressive jackpots and increased pay outs. Similarly, the present invention may, depending on the operator, require maximum coins to be played in order to participate in the secondary game. The player then starts the reels spinning by depressing the spin button or pulling the activation arm.

It is contemplated that the present invention may be implemented on slot machines having multiple pay lines. For example, slot machines may have from 1 to 9, and even more, paylines. The only variation from the traditional one payline machine being described herein is that different predefined winning and non-winning primary game outcomes need to be created. For example, a predefined winning primary game outcome may be based on one or more paylines having predefined gaming indicia or may require a certain number of predefined gaming indicia within the entire display area. In addition, a predefined non-winning primary game outcome, resulting in a 1-yard gain depicted on a secondary game display, may be defined as 50% or more of the individual paylines not resulting in a player payout.

Assuming the three reels 4 of the primary game 5 come to rest in a predefined winning combination, the secondary game is activated. In a first embodiment, the video display 26 displays a selected piece of football footage stored within the memory of the gaming machine 5. The results of the football footage correspond to the secondary game outcome. Each secondary game outcome is then added, or subtracted (e.g. a loss of yardage) to the previous outcome until a bonus event is realized. In a second embodiment shown in FIG. 2, a secondary game apparatus 27, in communication with said primary gaming machine 5, includes a plurality of sections 28 each having a distinct secondary outcome 29 depicted thereon. Although shown in a general shape of an American football, the secondary game apparatus 27 can take any form or shape. In this arrangement, the sections 28 can be individually illuminated in a flashing sequence or flashed simultaneously until ultimately one of the sections 28 remains illuminated thereby exhibiting the resultant secondary game outcome 29 as depicted thereon. The secondary game outcome 29 may or may not then be displayed on the video display 26 through a corresponding piece of stored football footage. The secondary game apparatus 27 is ideal for attracting players and adding suspense to the player's experience. In either embodiment, if the primary game 5 does not result in a winning combination, the secondary game outcome is predefined as a small yardage gain (e.g. one yard) preferably without the necessity for the stored video footage or secondary game apparatus 27. The video display 26 will continue to show the one yard advancement thereby tracking the status towards the bonus event. Between secondary game activations, the video display 26 will depict a status of the game by preferably showing the position of the football on a simulated football field 31 (shown in FIGS. 1, 2 and 3). It should be understood that other means of showing the status are available without departing from the scope of the present invention.

Figure 3:
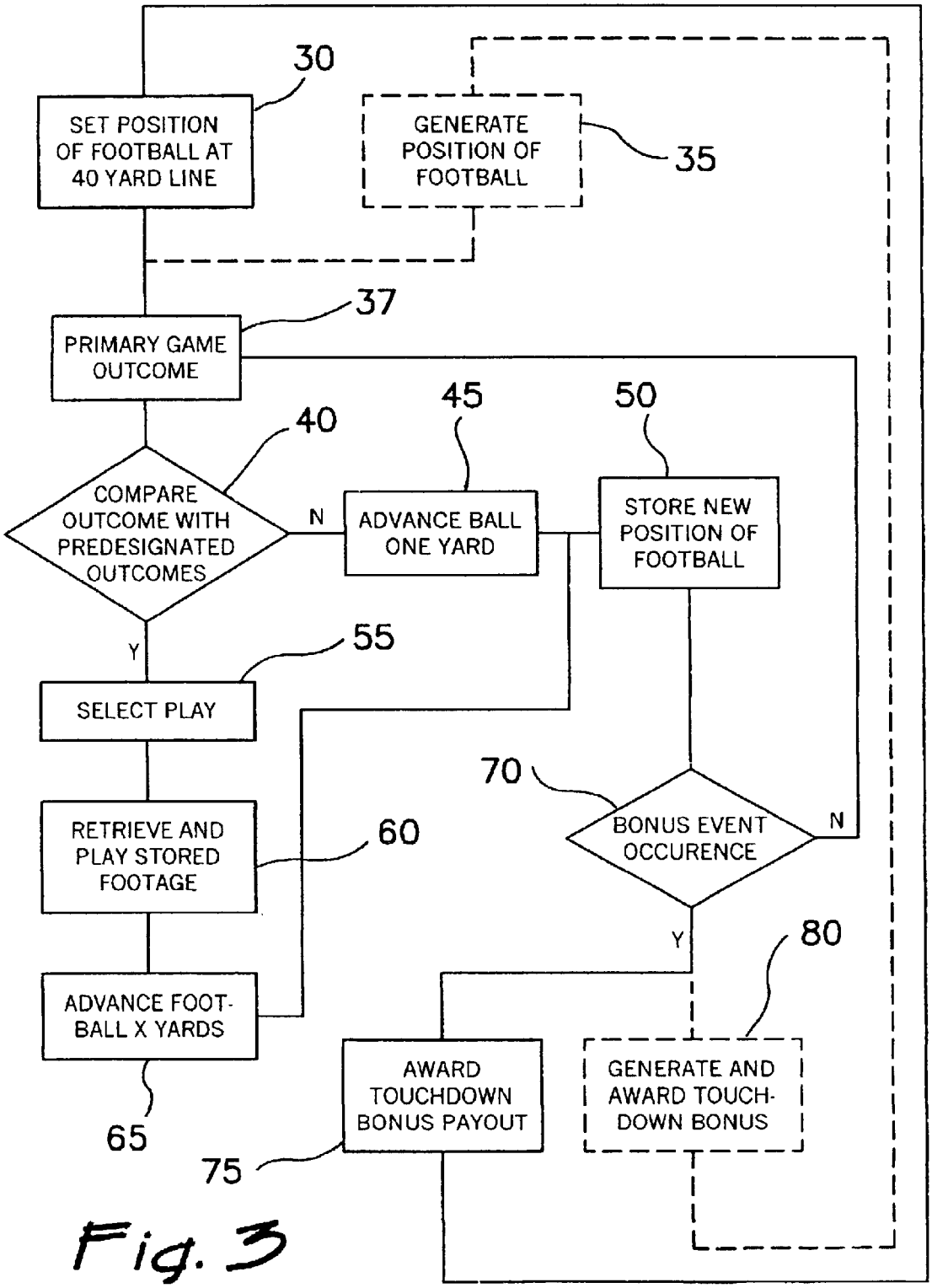
FIG. 3 illustrates a flow chart detailing the operation of a first embodiment of the present invention with a touchdown bonus event.

A flow chart detailing the operation of the secondary game having a touchdown bonus event is shown in FIG. 3. A preprogrammed microprocessor controls the gaming machine of the present invention (it is known in the art to utilize microprocessors to operate gaming machines such that significant details are not recited herein). The initial location of the football is either placed at a predesignated location (e.g. the 40yard line nearest the bonus end zone) or randomly generated by a random number generator in steps "SET POSITION OF FOOTBALL AT 40 YARD LINE" 30 or "GENERATE POSITION OF FOOTBALL" 35 (shown in dotted lines) respectively. Of course, should the player begin playing a gaming machine which a previous player abandoned prior to scoring a touchdown, the location of the football will remain at a final position from the previous player and will not be re-positioned.

At step 37 a "PRIMARY GAME OUTCOME" is determined once a player activates the gaming machine. Thereafter, as shown in step "COMPARE OUTCOME W/PREDESIGNATED OUTCOMES" 40 the microprocessor compares the primary game outcome to stored predesignated outcomes to determine whether a match has occurred. Should a first outcome of the primary game result in no match with a predefined outcome, the secondary game is directed by the microprocessor to advance the position of the displayed football a pre-established distance of preferably one yard as denoted by step "ADVANCE BALL ONE-YARD" 45. After the ball is advanced at step "ADVANCE BALL ONE-YARD" 45, the microprocessor stores in a memory location the new position of the football at step "STORE NEW POSITION OF FOOTBALL" 50. The memory location may be integrated in the microprocessor or may simply be in communication with the microprocessor. Preferably the position of the football is stored as the yardage from the target or bonus event end zone such that a football located at the 40-yard line nearest the target or bonus event end zone stores yardage of 40 yards whereas a football located at the 20-yard line opposite the bonus event end zone stores yardage of 80 yards. Means for displaying the location of the football are implemented such that a game player is always aware of the distance from a bonus event.

On the other hand, if a match is identified at step "COMPARE OUTCOME W/PREDESIGNATED OUTCOMES" 40, step "SELECT PLAY" 55 is implemented. At step "SELECT PLAY" 55 a random number generator selects a number corresponding to a stored football result. The stored football results will be weighted such that the random number generator is more likely to select a small yardage gain. However, the manufacturer and/or operator will ultimately define the frequency of yardage gains/loses and bonus amounts based on a desired pay out percentage. Casinos typically display the pay out percentage of a particular bank of gaming machines to encourage players to play high pay out machines.

In the preferred embodiment, once the football result is randomly selected, at step "RETRIEVE AND PLAY STORED FOOTAGE" 60 stored footage of live football plays corresponding to, and replicating, the selected football result is retrieved and played on the display 26. At the conclusion of the displayed football play, step "ADVANCE FOOTBALL X YARDS" 65 advances the position of the football a distance of X yards whereby X is a positive or negative integer representing the yardage gained or lost according to the randomly selected football result. After the ball is advanced at step "ADVANCE FOOTBALL X YARDS" 65, the microprocessor, as described above at step "STORE NEW POSITION OF FOOTBALL" 50 stores in the memory location the new position of the football.

After the position of the football is stored, the microprocessor queries whether a predefined bonus event has occurred at step "BONUS EVENT OCCURRENCE" 70 by comparing each yardage advance of the football to the previous distance from the end zone. If the yard advance is less than the distance to the end zone, no bonus event has occurred and the microprocessor awaits the result of the next primary game. If the yardage advance is greater than, or equal to, the distance to the end zone, a bonus event has been achieved and a bonus pay out is awarded at step "AWARD TOUCHDOWN BONUS PAY OUT" 75. The amount of the bonus award may be pre-established or may be generated by the random number generator. If the amount of the award is pre-established, it is stored in the memory location and retrieved upon the achievement of the bonus event. Alternatively, if the amount of the award is randomly generated, it is generated at step "GENERATE AND AWARD TOUCHDOWN BONUS" 80 (shown in dotted lines). Although not shown, it should be understood that the award may be based on other factors, including the length of the touchdown play or the number of plays required to reach the end zone.

Upon the award of the bonus, the occurrence of the bonus event causes the secondary game to re-set such that the ball is placed at its initial pre-established location by looping to step "SET POSITION OF FOOTBALL AT 40 YARD LINE" 30. In the alternative, the position of the football can be randomly established at step "GENERATE INITIAL POSITION OF FOOTBALL" 35. Thereafter, the game once again proceeds according to the flow chart illustrated in FIG. 2.

Figure 4:
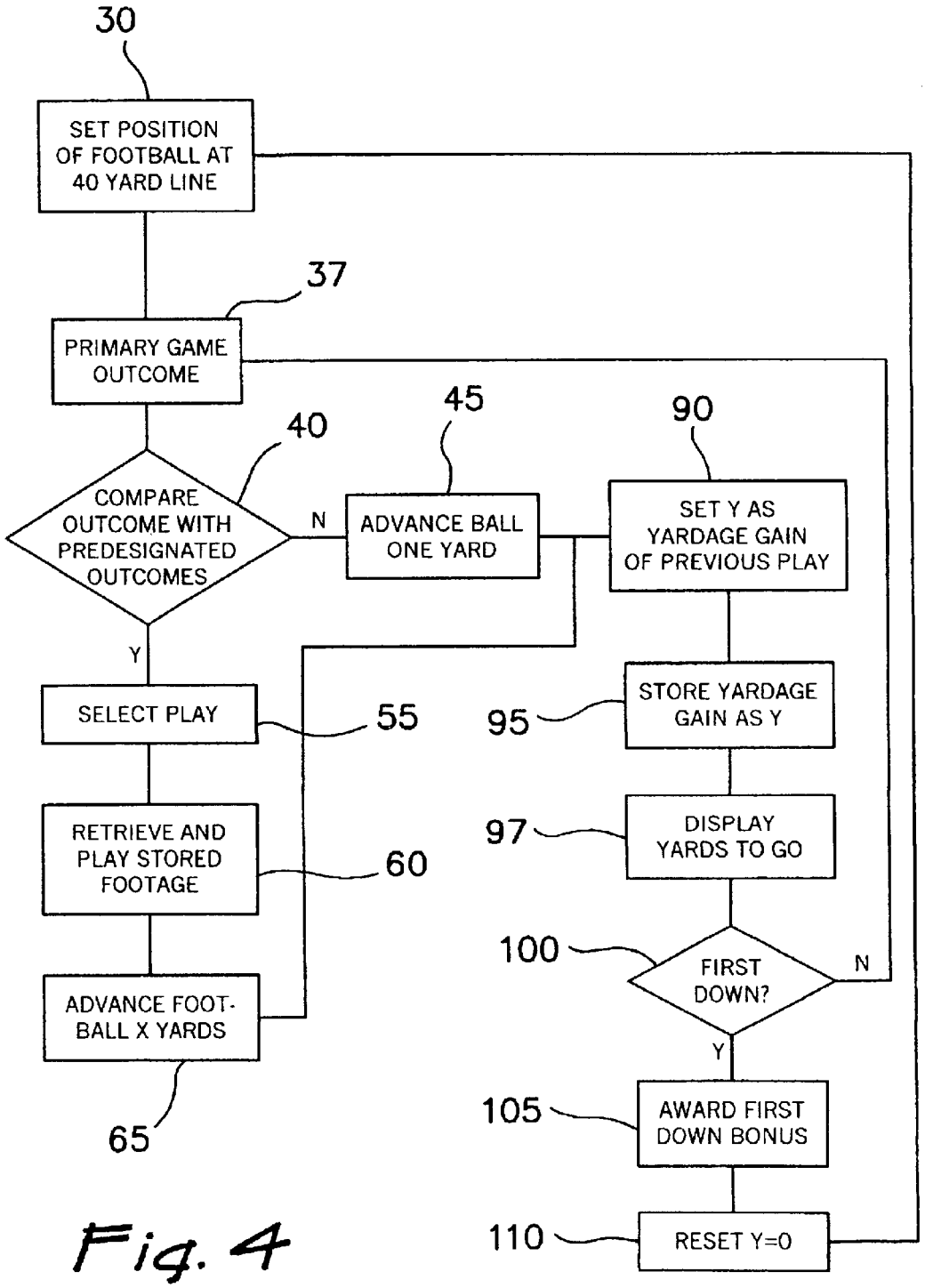
FIG. 4 illustrates a flow chart detailing a second embodiment of the present with a first down bonus event.

The flow chart illustrated in FIG. 4 shows a section of a flow chart of an embodiment having a first down bonus event. Additional steps of "SET Y AS YARDAGE GAIN OF THE PREVIOUS PLAY" 90, "STORE YARDAGE GAIN AS Y" 95, DISPLAY YARDS TO GO" 97, "FIRST DOWN?" 100 and "RE-SET Y TO ZERO" 110 are present. Yardage gained or lost on each secondary game play is added and stored as integer Y (initially set as zero) until the total yardage gained is greater than, or equal to, for example, 10 yards (i.e. 10 yards is the first down distance in professional and college football) at which time a first down is achieved and a bonus amount is awarded. The integer Y is re-set after each play of the secondary game at step "STORE YARDAGE GAIN AS Y" 95 by adding the new play yardage from step "SET Y AS YARDAGE GAIN OF THE PREVIOUS PLAY" 90 to the previous play yardage and then comparing the summed result to the pre-established first down distance of 10 yards. Step "DISPLAY YARDS TO GO" 97 provides a players with a visual display of the yardage needed to reach the first down and corresponding bonus award. If 10 yards has been gained, a bonus is paid at step "AWARD FIRST DOWN BONUS" 105 and integer Y is re-set to zero. As with the touchdown bonus, the first down bonus, and all other bonuses, may be pre-established or generated randomly.

While not shown it is a simple matter, and within the scope of the present invention, to implement the touchdown bonus and first down bonus in the same game such that the player receives multiple bonuses during play. In fact, any number of bonuses may be included without departing from the spirit of the present invention. Further, while the present invention has been described in connection with a slot machine, the primary game may be any gaming machine, including a video poker machine.

Although the invention has been described in detail with reference to a preferred embodiment, additional variations and modifications exist within the scope and spirit of the invention as described and defined in the following claims.

We claim:

1. An electronically implemented gaming machine including:

a primary game in communication with a processor; and a secondary game in communication with said primary game, said secondary game displaying secondary game outcomes generated by said processer in response to predefined winning and non-winning outcomes of said primary game, said processor summing the outcomes of each successive secondary game play until a predefined outcome value is achieved or surpassed.

2. The electronically implemented gaming machine of claim 1 wherein said gaming machine issues a payout to a player once said predefined secondary game value has been achieved or surpassed.

3. The electronically implemented gaming machine of claim 1 wherein said primary game is a slot machine.

4. The electronically implemented gaming machine of claim 1 wherein said gaming machine includes display means for displaying a current status of the secondary game.

5. The electronically implemented gaming machine of claim 2 wherein said secondary game is based on American football such that the secondary game outcome is in terms of gains or losses of yardage.

6. The electronically implemented gaming machine of claim 5 wherein said secondary game outcome is a one yard gain in response to a predefined non-winning primary game outcome.

7. The electronically implemented gaming machine of claim 5 wherein said secondary game outcome is randomly generated in response to a predefined winning primary game outcome.

8. The electronically implemented gaming machine of claim 5 wherein said gains or losses of yardage are presented by displaying stored video footage of live football plays corresponding to the gain or losses of yardage.

9. The electronically implemented gaming machine of claim 5 wherein said secondary game payout occurs when said predefined value corresponds to scoring a touchdown.

10. The electronically implemented gaming machine of claim 5 wherein said secondary game payout occurs when said predefined value corresponds to a predefined amount of yardage.

11. A method of executing a secondary game in communication with a primary game including:

a) activating said primary game;

b) generating a secondary game outcome in response to predefined winning and non-winning outcomes of said primary game;

c) summing each secondary game outcome with each previous secondary game outcome; and d) repeating steps a), b) and c) until the sum of the secondary game outcomes equals or surpasses a predefined outcome value.

12. The method of executing a secondary game in communication with a primary game of claim 11 further including a step of awarding a player a payout once said predefined value is equaled or surpassed.

13. The method of executing a secondary game in communication with a primary game of claim 11 wherein said primary game is a slot machine.

14. The method of executing a secondary game in communication with a primary game of claim 11 further including a step of displaying a current status of the secondary game.

15. The method of executing a secondary game in communication with a primary game of claim 12 wherein said secondary game is based on American football such that the secondary game outcome is in terms of gains or losses of yardage.

16. The method of executing a secondary game in communication with a primary game of claim 15 wherein said secondary game outcome is a one yard gain in response to a predefined non-winning primary game outcome.

17. The method of executing a secondary game in communication with a primary game of claim 15 wherein said secondary game outcome is randomly generated in response to a predefined winning primary game outcome.

18. The method of executing a secondary game in communication with a primary game of claim 15 wherein the secondary game outcome in terms of gains or losses of yardage is presented by displaying stored video footage of live football plays corresponding to the gains or losses of yardage.

19. The method of claim 15 wherein said secondary game payout occurs when said predefined value corresponds to scoring a touchdown.

20. The method of claim 15 wherein said secondary game payout occurs when said predefined value corresponds to a predefined amount of yardage.

21. A method of playing a football-based game including:

a) activating a primary game, said primary game selected from the group consisting of video poker and slots;

b) generating a secondary game outcome in response to predefined winning and non-winning outcomes of said primary game, said secondary game outcomes corresponding to a gain or loss of yardage;

c) aggregating each secondary game gain or loss with each previous secondary game gain or loss; and d) repeating steps a), b) and c) until the aggregate gain or loss of the secondary game equals or surpasses a predefined aggregate gain or loss.

22. The method of claim 21 wherein said secondary game outcome is a one yard gain in response to a predefined non-winning primary game outcome.

23. The method of claim 21 wherein said secondary game outcome is randomly generated in response to a predefined winning primary game outcome.

24. The method of claim 21 wherein the secondary game outcomes are presented by displaying stored video footage of live football plays corresponding to the randomly generated gains or losses.

* * * * *